US005153811A

United States Patent [19]

Rodrigo et al.

[11] Patent Number: 5,153,811

[45] Date of Patent: Oct. 6, 1992

[54] SELF-BALANCING IONIZING CIRCUIT FOR STATIC ELIMINATORS

[75] Inventors: Richard D. Rodrigo, Line Lexington; Timothy A. Good, Royersford, both of Pa.

[73] Assignee: ITW, Inc., Glenview, Ill.

[21] Appl. No.: 751,093

[22] Filed: Aug. 28, 1991

[51] Int. Cl.[5] ..... H01T 23/00

[52] U.S. Cl. ..... 361/231; 361/220; 361/230

[58] Field of Search ..... 361/212, 220, 222, 230, 361/231, 235

[56] References Cited

U.S. PATENT DOCUMENTS

| | | | |
|---|---|---|---|
| 4,227,894 | 10/1980 | Proynoff | 361/231 |
| 4,689,715 | 8/1987 | Halleck | 361/231 |
| 4,745,282 | 5/1988 | Tagawa et al. | 361/230 |
| 5,055,963 | 10/1991 | Partridge | 361/231 |

*Primary Examiner*—Jeffrey A. Gaffin
*Attorney, Agent, or Firm*—Stanley Bilker

[57] ABSTRACT

A self-balancing ionizing circuit for electrical static eliminators having high voltage (pointed) discharge electrodes employs an insulative duct spaced peripherally thereabout. The duct has at least an open exit end with a non-conductive protective grille at the duct terminus in longitudinally spaced disposition from said electrodes. One side of an ungrounded secondary coil of an A.C. high voltage transformer is directly or resistively connected electrically to the discharge electrodes while the other side of the transformer secondary is electrically coupled to an ungrounded conductive band supported within the insulative duct adjacently spaced from the discharge electrodes to define a floating reference electrode with respect thereto. The electric field for ionization is produced between the discharge electrodes and the reference electrode. Grounding is effected only by way of an external conductive chassis for the system which is shielded from the internal ionization process by the dielectric of the insulative duct. Isolating the reference electrode from ground permits substantial voltages to be developed thereon without creating the ionization imbalance normally produced by adjacent grounded components, such as grounded casings or the like. Balancing of positive and negative ion production is independent of capacitors or other electrical components, and no mechanical adjustment is required to compensate for changes in environmental factors or contamination conditions. With no capacitors which can become leaky, the system provides high reliability with fewer parts, thereby minimizing costs.

13 Claims, 2 Drawing Sheets

SELF-BALANCING IONIZING CIRCUIT FOR STATIC ELIMINATORS

BACKGROUND OF THE INVENTION

1. Field of the Invention

This invention relates to electrical static eliminators and more particularly relates to corona discharge devices in which discharge electrodes, usually pointed, are coupled to the high side of an A.C. high voltage power supply whose ground side is normally connected to a conductive member or casing adjacently spaced from the discharge points to produce both positive and negative ions in the air gap therebetween. The dual polarity ions emitted by these static eliminators are used to neutralize the surfaces of articles which have become electrically charged by frictional, mechanical, electrical or other generated forces.

The present invention is especially concerned with ionized air blowers in which air, or other gas, is directed over the ionizing points to increase the range of the ionizing field and includes means for balancing the positive and negative ion production so that an equal number of ions of each polarity will be provided thus to insure complete neutralization of the targeted articles.

2. Prior Art

Static eliminators are devices for producing both positive and negative ions in order to neutralize articles or materials which have become charged to a particular polarity or which have a net residual charge in certain zones on the surface. When an A.C. high voltage of fairly high magnitude, for example 15,000 volts, is applied across the discharge points and the grounded casing or shield of such static eliminators, positive and negative ions are emitted from the static discharge electrodes.

While positive and negative ion production may be equal under certain circumstances, in most cases one or the other polarity of ions will predominate depending upon (1) the manner in which the high voltage is connected to the ionizing points, i.e. whether the the points are resistively coupled as in a directly connected bar or capacitively coupled as in a "shockless" bar, (2) the geometry of the static bar, especially the configuration of the grounded portions of the bar and the relationship thereof with respect to the ionizing points, (3) the distance between the static bar and the material to be discharged, and (4) the presence of adjacent grounds with respect to the bar, the latter affecting the amounts of the respective positive or negative ions being emitted from actually reaching the charged material.

In the direct connected bar, such as set forth in U.S. Pat. No. 2,163,294 or U.S. Pat. No. 3,137,806, there is usually a predominance of negative ions produced, even though the discharge points are connected to an A.C. power supply whose positive and negative output voltages are of equal magnitude. The excess negative ion production is as a result of the greater mobility of the negative ions and also because of the inherent characteristics of corona formation wherein ionization occurs over a greater portion of the negative half cycle of voltage in relation to the ionization occurring during the comparable positive half cycle.

In the case of the capacitively coupled bar, such as is described in U.S. Pat. No. 3,120,626, U.S. Pat. No. 3,443,806 or U.S. Pat. No. 3,585,448, there is usually a prevalence of positive ions emitted resulting from the fact that a D.C. voltage is developed across the capacitance in the direction which biases the points slightly positively. The material to be discharged may charge up to the polarity of the predominantly positive charge produced by the capacitively coupled bar or to the preponderantly negative charges emitted by the direct coupled bar.

In U.S. Pat. No. 4,188,530, there is illustrated an extended range static eliminator in which air is blown across the ionizing points through a series of openings toward articles remotely located from the discharge electrodes. The articles themselves are shielded by a casing from corona glow developed about the points.

In U.S. Pat. No. 4,093,543, there is shown and described a balanced ion emission system for a "shockless" capacitively coupled arrangement wherein grounded pointed conductive needles are adjacently and adjustably spaced from some of the pointed discharge electrodes. The points of the "balancing" or control needles are adapted to be adjustably positioned mechanically with respect to the discharge electrodes until an equal number of ions of each polarity are emitted.

In U.S. Pat. No. 4,423,462, a controlled emission static eliminator system is provided by incorporating a biasing circuit in series with the primary of the power supply transformer to control the amplitude and/or duration of the alternating potentials imposed on the corona discharge points. The biasing circuit includes a series-connected diode and a variable resistance in one leg of a parallel network and a capacitor in the other leg. Selecting appropriate time constants for the resistance and capacitance enables the first half of the sine wave to be narrowed while the second half is broadened (or vice versa, depending upon whether the A.C. is directly or capacitively coupled to the points) to yield an equal number of ions of each polarity.

In U.S. Pat. No. 2,879,395, equalization of ion production is accomplished by incorporating a small D.C. power supply either between the bar casing and ground or between the A.C. generator and ground. Adjustment of the magnitude of the auxiliary D.C. voltage provided the desired balance by retarding the output of ions of the opposite polarity.

U.S. Pat. No. 3,714,531 relates to a device for controlling the ratio of positive and negative ions by means of a pair of auxiliary secondary coils, including means for distorting the voltage on the other secondary.

U.S. Pat. No. 4,665,462 concerns an ionizing gas gun for balanced static elimination wherein delay circuitry is included to suspend discontinuance of the positive high voltage for a momentary period subsequent to discontinuance of the negative high voltage.

In U.S. Pat. No. 4,872,083 balance control is achieved by a by-pass resistor across the circuit capacitance to provide a path to ground that bleeds off excess bias so that equal positive and negative ion densities are generated during corona flow.

U.S. Pat. No. 4,417,293 is directed to a static eliminator system employing a pressurized gas which, upon expansion through a nozzle, changes phase and entraps air ions within frozen microparticles, allowing them to be propelled over greater distances. One aspect of this device is said to provide balanced ion emission by embeding the conductive nozzle tip within an insulated jacket while applying the high voltage to the discharge electrodes through a capacitor. The conductive tip or ring electrode providing the ionization field with respect to the discharge electrode is grounded directly.

All of the foregoing balancing systems employ either mechanical or electrical adjustment means to compensate for changes in positive and negative ion flow that are caused by environmental factors and contamination and/or incorporate one or more capacitors in the high voltage circuit before the discharge electrodes or between the ionization field-creating reference electrode and ground to achieve equalization of positive and negative ions.

3. Objectives of the Present Invention

It is therefore an object of this invention to provide a static eliminator system in which ion emission can be balanced without the need for auxiliary mechanical or electrical adjusting devices.

Another object of this invention is to provide a self-balancing ionization circuit for electrical static eliminators wherein equalization of positive and negative ion flow is accomplished without employing capacitors or diodes or other leakage sensitive electrical components intermediate the high voltage power supply and the discharge electrodes or between the field creating reference electrodes and ground.

Still another object of this invention is to provide a self-balancing circuit for static eliminators in which the secondary of the high voltage transformer is totally isolated from ground.

Yet another object of this invention is to provide a highly stable and reliable balancing circuit for extended range static eliminators whose assembly is accomplished with minimal parts and without adjustment mechanisms.

Other objects of this invention are to provide an improved device of the character described which is easily and economically produced, sturdy in construction and both highly efficient and effective in operation.

SUMMARY OF THE INVENTION

In accordance with the present invention, there is provided a self-regulating balancing circuit for electrical static eliminators to produce emission of an equal number of positive and negative ions, especially in connection with a high voltage A.C. ionized air blower. Automatic balancing is accomplished by totally isolating the secondary of the high voltage power supply and the ionization field electrodes from ground. One side of the transformer secondary is directly or resistively coupled (i.e. non-capacitively connected as opposed to capacitively coupled) to the discharge electrodes while the other side is directly coupled to an ungrounded conductive band located upon the interior of an open-ended, non-conductive duct which is in peripherally spaced adjacent disposition about the discharge electrodes to define a floating reference electrode with respect thereto.

Only the external metal chassis for the static eliminator of the instant invention is grounded, such conductive chassis acting to shield the static eliminator system from external static fields. In addition, all components of the conductive chassis are sufficiently isolated from the discharge electrodes by the dielectric of the insulative air duct or conduit as to prevent flow of corona current to the conductive chassis and degradation of the ionization field. By shielding the grounded metal chassis from the ionization process, grounded components are isolated therefrom to the extent that they cannot interfere with balance.

The present invention, in contrast to prior devices, does not rely upon or incorporate any electrical components, such as capacitors, resistors, variable resistors, diodes, transistors, amplifiers, integrated circuits or the like, to achieve balance of an equal number of ions of each polarity. Also, in contrast to typical ionizing air blowers which use a metal grille as both a finger guard and reference electrode, the instant invention retracts all ionization field-producing electrodes well within the internal dielectric insulative casing thereby avoiding exposure of operating personnel to high voltage shock. Capacitive coupling which has been used previously both as a balancing means and as a means for current limiting against shock has been eliminated.

BRIEF DESCRIPTION OF THE FIGURES

With the above and related objects in view, this invention consists of the details of construction and combination of parts as will be more fully understood from the following detailed description when read in conjunction with the accompanying drawing in which.

DETAILED DESCRIPTION OF PREFERRED EMBODIMENTS

Figure 1:
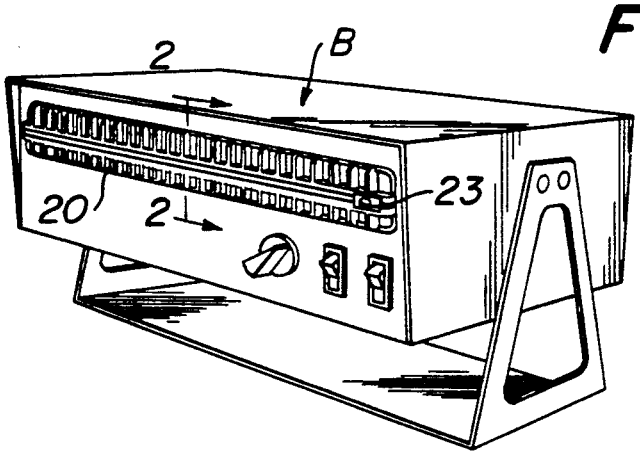
FIG. 1 is a perspective view of an ionized air blower having a balancing circuit for producing an equal number of ions of each polarity in accordance with the instant invention.

Referring now in greater detail to the drawings in which similar reference characters refer to similar parts, there is shown an electrical static eliminator comprising one or more discharge electrodes, generally designated as A, mounted within a chassis or housing, generally designated as B, and coupled to an A.C. high voltage power supply C for generating both positive and negative ions at the points 10 of said electrodes.

Figure 5:
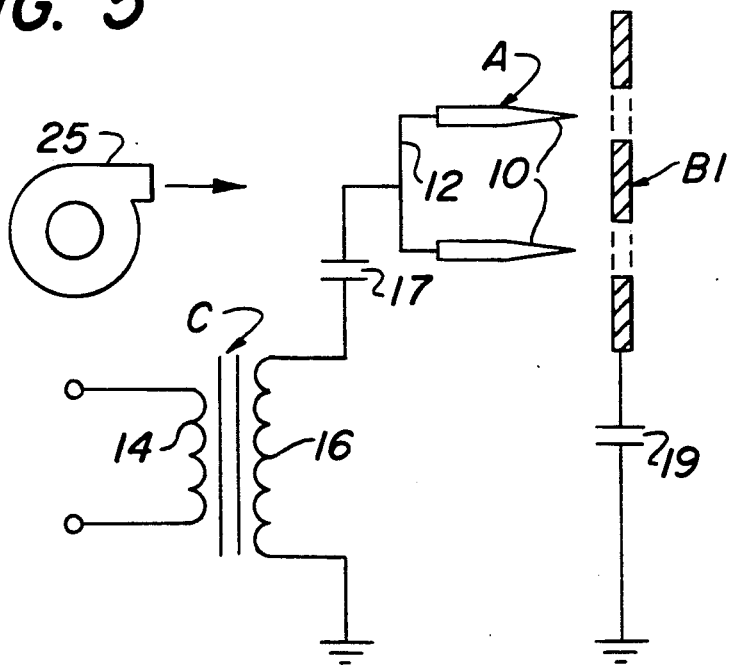
FIG. 5 PRIOR ART
FIG. 5 is an electrical schematic diagram of a typical prior art ionizing air blower.

In FIG. 5, there is shown a schematic representation of a extended-range static eliminator of the prior art in which the secondary of the high voltage power supply C is coupled across the the discharge electrodes A and the apertured metal terminus B1 of chassis B adjacent the points 10 wherein dual polarity ions will be produced in the air gap therebetween. The power supply C comprises a conventional high voltage transformer having a primary coil 14 and a secondary coil 16 capable of providing about 6 to 15 kilovolts A.C. The low side of the secondary 16 is connected directly to ground whereas the other side of the secondary is coupled to the points 10 through a capacitor 17. The apertured conductive terminus B1 of the chassis is also coupled to ground by way of suitable capacitor 19. The points 10 of the discharge electrodes A are of any suitable conductive material, such as stainless steel or brass, and extend from a bar 12 which is insulated from the metal chassis B. The capacitive coupling 17 between the discharge electrodes A and the capacitive coupling 19 between the apertured terminus B1 of the casing B are said to provide self balancing as a consequence of charge-up of the conductive terminus B1 to a voltage exactly counterbalancing that of the excessive positive or negative ion currents.

Figure 2:
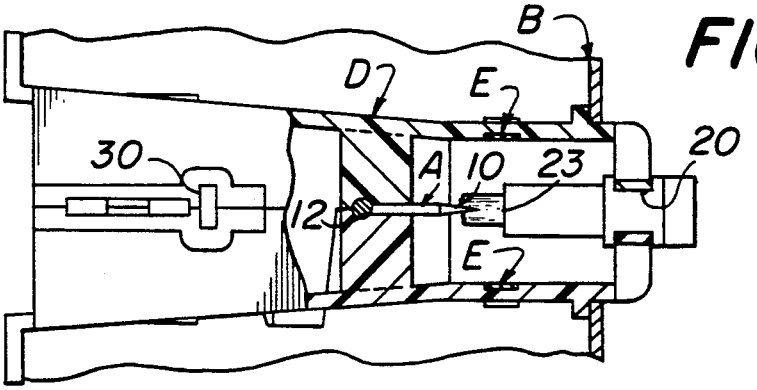
FIG. 2 is a sectional view taken along lines 2—2 of FIG. 1.
Figure 3:
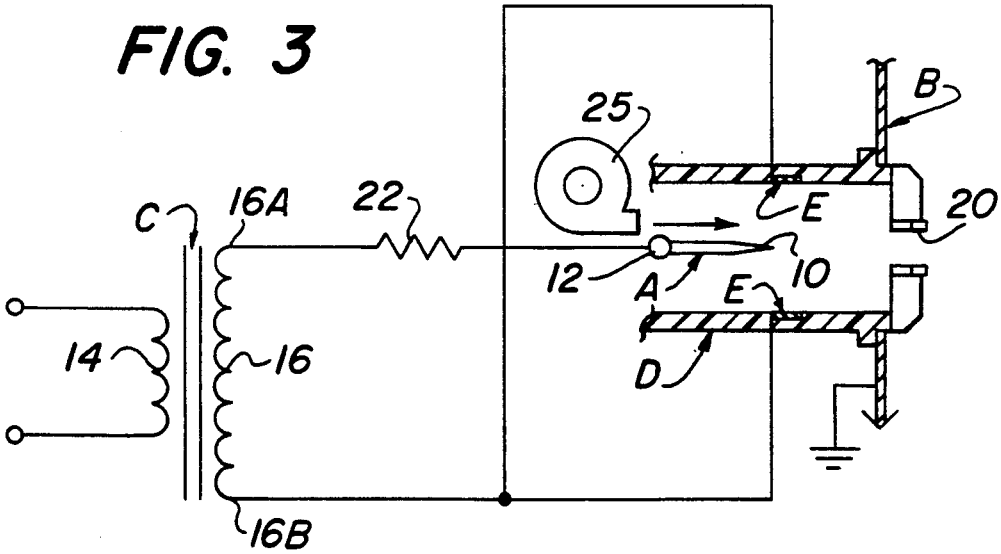
FIG. 3 is an electrical schematic diagram of the balancing circuit employed in this invention.

In one embodiment of the present invention, as best illustrated in FIGS. 2 and 3, the points 10 of the discharge electrodes A extend from bar 12 transversely mounted within a dielectric conduit or duct D so that the points 10 longitudinally project toward the distal end of duct D, the latter being open to permit the dual polarity air ions to be blown therethrough. A reference electrode E in the form of a rectangularly configured conductive band is mounted on the interior of the duct D and is adjacently spaced from the discharge electrodes A substantially peripheral to the discharge points 10. The duct D is made of a suitable high dielectric material, such as a polyolefin, polyethylene or the like, whose insulative properties will prevent any corona breakdown from the discharge points 10 or the reference electrodes E to the grounded metal chassis B at the distances set. Again, the power supply C is conventional and comprises a high voltage transformer having a primary coil 14 and a secondary coil 16 capable of providing about 6 to 15 kilovolts A.C. One side 16A of the secondary 16 is resistively coupled to the discharge electrodes A while the other side 16B of the secondary is connected to the reference electrode E to create an ionizing field in the gap between the points 10 and the conductive band electrode. It is important to note that no portion of the secondary coil 16 is connected to ground, and neither the discharge electrodes A nor the reference electrode E are grounded so that the ionization field is a floating one effectively isolated from ground. That is, the conductive chassis B is shielded from the field electrodes A–E by the dielectric thickness of the duct conduit D so as to prevent corona traversal thereacross which would impair the efficacy of ionization balancing by virtue of adjacency of the grounded chassis. In this regard, the spacing of the air gap between the discharge electrodes A and the reference electrodes E is optimally about 0.300 inches while the spacing of the points 10 to the nearest adjacency of the necked down position of the conductive chassis B is approximately one-half inch with the dielectric cross-section of the insulated conduit D included.

An insulative plastic grille 20 is incorporated over the exit terminus of the duct D in order to prevent accidental contact by the fingers of operating personnel with the high voltage field electrodes A or E. While no capacitor or diode is included in the high voltage circuitry, leakage of which could act detrimentally to the delicate balance of positive and negative ion emission, a current limiting resistor 22 may be incorporated without interfering with ion balance to prevent excessive currents from flowing in the event of accidental shunting of high voltage components. This resistor 22 also buffers current from the ionizer during its normal life and in the presence of contamination.

While not an integral part of the instant invention, a traversing brush 23, such as shown in U.S. Pat. No. 4,734,580, may be slidably oriented in the grille 20 so that the bristles thereof may wipe across the discharge points 10 in order to clean them of dust and/or contamination.

A stream of air by way of blower or fan 25 may be blown longitudinally over the points 10 and through the conduit D so that the ionized air stream will exit through the grille 20 and impinge over an extended distance toward a remote zone or targeted area. The number of discharge points 10 may vary from many, for example fifteen, to just one (not specifically shown) in which latter case the conduit would constitute a cylindrical barrel in the form of an ionizing air gun or cylinder. Suitable apertures 30 are provided in the duct B to enable electrical facilities to be connected from the exterior to internal heaters for warming the air.

Figure 4:
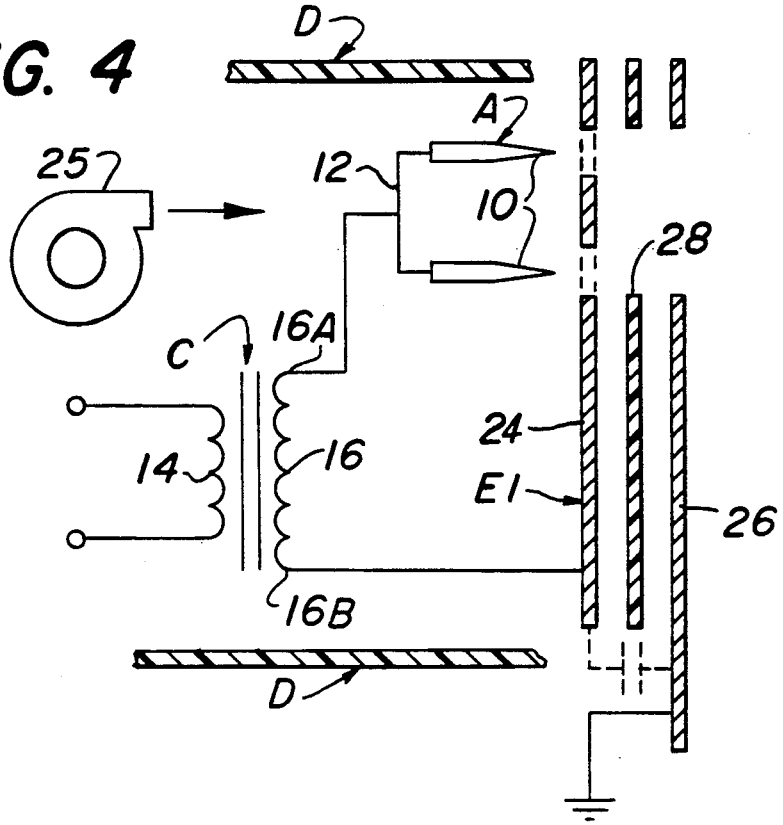
FIG. 4 is an electrical schematic diagram of a modified version of the present invention.

In FIG. 4, there is set forth a modified version of the present invention wherein the discharge electrodes A are again directly coupled to one side (16A) of the transformer secondary 16 while the other side (16B) of the transformer secondary coil is coupled to a flat metal foraminous plate 24 in the form of a screen, typically punched or expanded metal, which acts as a reference electrode E1. Here, the metal chassis B is grounded and embodies a conductive face plate 26 which is superimposed over the apertured screen 24 and compositely formed with a dielectric spacer 28 therebetween. The dielectric thickness of the spacer 28 prevents corona breakdown between the points 10 of discharge electrodes A and the chassis face plate 26 but allows an ionizing field to exist in the air gap between the discharge electrodes A and the margins of the openings in reference electrode E1 through which the dual polarity ions are blown. Although the metal screen 24 is capacitively coupled to the grounded face plate 26 via the dielectric of spacer 28, the dielectric of said spacer 28 is sufficient to isolate the ionizing field from ground and thereby maintain balance.

Throughout the preceding text and with respect to the appended claims, there terms "directly connected" and "resistively connected" have been used herein basically interchangeably with the intent that they are continuous in the physical sense to distinguish these terms from capacitive couplings or diodes and the like which are discontinuous electrical components. Thus, physical continuity of a resistive coupling or of a direct coupling (the latter being the case of zero resistance) is to be differentiated from capacitors or diodes wherein there is an internal gap with respect to such electrical components which are subject to leakage or other breakdowns conducive to unbalanced ion producing conditions.

Tests on the apparatus of the instant invention in accordance with EOS/ESD Standard No. 3 (EOS-/ESD-3) show that offset voltages of zero +/−5 volts are automatically maintained at the 12 test points designated by said standards. Decay times within the distances and beam set out were less than about 30 seconds.

Although this invention has been described in considerable detail, such description is intended as being illustrative rather than limiting, since the invention may be variously embodied without departing from the spirit thereof, and the scope of the invention is to be determined as claimed.

What is claimed is:

1. A self-balancing ionizing circuit for electrical static eliminators comprising:

a) an insulative conduit having an apertured distal end, b) a grounded conductive chassis defining a jacket for said conduit and forming a shield for the static eliminator, c) at least one discharge electrode in said conduit having a point directed toward the distal end of the insulated conduit, d) a conductive member adjacently spaced from said at least one discharge electrode, e) a high voltage A.C. transformer having an ungrounded secondary coil with one side directly connected to said at least one discharge electrode and one side directly connected to the conductive member, said insulative conduit having a dielectric thickness sufficient to prevent corona formation between said discharge electrode and said grounded conductive chassis, said discharge electrode and said conductive member being further isolated from ground so that said conductive member defines a floating reference electrode with respect to said discharge electrode whereby a self-regulating balanced ion emission may be achieved without capacitors, diodes or adjustments.

2. The self-balancing ionizing circuit of claim 1 wherein said conductive member comprises a metal band circumferentially spaced about said at least one discharge electrode and longitudinally spaced from the distal end of said conduit.

3. The self-balancing ionizing circuit of claim 1 wherein said conductive member comprises an apertured plate adjacent the distal end of said conduit, and a portion of said chassis is capacitively coupled to said apertured plate by a dielectric.

4. The self-balancing ionizing circuit of claim 1 including a current limiting resistor intermediate said at least one discharge electrode and the side of the ungrounded secondary coil connected thereto.

5. The self-balancing ionizing circuit of claim 1 including means for directing a stream of air over said at least one discharge electrode and through the distal end of the insulative conduit.

6. A self-balancing ionizing circuit for electrical static eliminators comprising (a) an insulative conduit having an apertured distal end, (b) a grounded conductive chassis defining a shielding jacket for the static eliminator with respect to external electrostatic fields, (c) a plurality of discharge electrodes having points directed toward the distal end of said insulative conduit, (d) means constituting a conductive reference electrode circumferentially spaced about said discharge electrodes, (e) a high voltage power supply having an ungrounded secondary coil with one side connected to said discharge electrodes and the other side directly connected to said means constituting a conductive reference electrode, said insulative conduit having a dielectric thickness sufficient to prevent corona formation between said discharge electrode and said grounded conductive chassis, said discharge electrodes and said reference electrode means being further isolated from ground so that said discharge electrodes and said reference electrode means float with respect to ground to provide a regulated balanced ion emission without capacitors, diodes or adjustments.

7. The self-balancing ionizing circuit of claim 6 wherein said reference electrode comprises a metal band spaced substantially peripheral to the points of said discharge electrodes.

8. The self-balancing ionizing circuit of claim 6 wherein a stream of air is blown over said discharge electrodes through the distal end of said conduit.

9. The self-balancing ionizing circuit of claim 6 wherein a current limiting resistor is incorporated intermediate said discharge electrodes and the side of the secondary coil connected thereto.

10. A self-balancing ionizing circuit for electrical static eliminators comprising:

(a) an insulative conduit having an apertured distal end, (b) at least one pointed discharge electrode mounted within said insulative conduit and directed toward the distal end thereof, (c) conductive electrode means adjacently spaced with respect to said at least one pointed discharge electrode, (d) a high voltage power supply having an ungrounded secondary coil with one side directly connected to said at least one pointed discharge electrode and the other side directly connected to said conductive electrode means, said insulative conduit having a dielectric thickness sufficient to prevent corona current flow between said at least one pointed discharge electrode and components exterior to said insulative conduit, said conductive electrode means defining a reference electrode spaced and isolated from ground whereby said at least one pointed discharge electrode and said reference electrode float with respect to ground to provide a regulated balance ion emission without capacitors, diodes or adjustments.

11. The self-balancing ionizing circuit of claim 10 wherein said reference electrode comprises a band peripherally spaced with respect to said at least one pointed discharge electrode.

12. The self-balancing circuit of claim 10 wherein a stream of air is blown over said discharge electrodes through the distal end of said conduit.

13. The self balancing ionizing circuit of claim 10 wherein a current limiting resistor is incorporated intermediate said at least one pointed discharge electrode and the side of the secondary coil connected thereto.

* * * * *